US009434456B2

(12) United States Patent
Højer

(10) Patent No.: US 9,434,456 B2
(45) Date of Patent: Sep. 6, 2016

(54) SUBMERGIBLE CLEANING SYSTEM

(71) Applicant: C-LEANSHIP APS, Hørsholm (DK)

(72) Inventor: Jesper Højer, Hørsholm (DK)

(73) Assignee: C-LEANSHIP A/S, Hørsholm (DK)

( * ) Notice: Subject to any disclaimer, the term of this patent is extended or adjusted under 35 U.S.C. 154(b) by 0 days.

(21) Appl. No.: 14/651,069

(22) PCT Filed: Dec. 11, 2013

(86) PCT No.: PCT/EP2013/076168
§ 371 (c)(1),
(2) Date: Jun. 10, 2015

(87) PCT Pub. No.: WO2014/090847
PCT Pub. Date: Jun. 19, 2014

(65) Prior Publication Data

US 2015/0307169 A1 Oct. 29, 2015

(30) Foreign Application Priority Data

Dec. 11, 2012 (EP) ..... 12196544

(51) Int. Cl.
*B63B 59/00* (2006.01)
*B63G 8/08* (2006.01)
(Continued)

(52) U.S. Cl.
CPC ..... *B63B 59/08* (2013.01); *B63G 8/08* (2013.01); *B63G 8/14* (2013.01)

(58) Field of Classification Search
CPC ..... B63B 59/00; B63B 59/06; B63B 59/08; B63G 8/00; B63G 8/08; B63G 8/14; B63G 8/16; B63G 8/38; B63G 8/39; B63G 2008/00; B63G 2008/001; B63G 2008/002; B63G 2008/005
USPC ..... 114/222, 312, 313, 330, 331, 337, 338
See application file for complete search history.

(56) References Cited

U.S. PATENT DOCUMENTS 5,014,803 A * 5/1991 Urakami ..... B62D 57/024 114/222
5,048,445 A * 9/1991 Lever ..... B63B 59/10 114/222

(Continued)

FOREIGN PATENT DOCUMENTS

EP 2 251 102 11/2010
FR 2 369 964 6/1978

(Continued)

OTHER PUBLICATIONS

International Preliminary Report on Patentability mailed Jun. 25, 2015 in International Application No. PCT/EP2013/076168 (7 pages).

(Continued)

*Primary Examiner* — Daniel V Venne
(74) *Attorney, Agent, or Firm* — Nixon & Vanderhye P.C.

(57) ABSTRACT

A submergible cleaning system (1) for cleaning an underwater hull surface (3) of a vessel while the vessel is afloat or an offshore facility, the cleaning system (1) comprising a housing (2) comprising a top face (3) and side faces (4) having edges (5) and an open bottom face, the edges (5) and bottom face being arranged opposite the hull surface (3), and the further comprising a rotary disc (6) having a plurality of nozzles (7) arranged around a periphery (30) of the rotary disc, the nozzles facing the hull surface (3), rolling spacing devices (8) for providing a predetermined first gap (9) between the rotary disc (6) and the hull surface (3), a suction device (10) fluidly connected to an outlet (11) arranged in the housing (2) for providing a negative pressure within the housing (2), a pressurizing device (12) fluidly connected with the nozzles (7) for providing a high pressure fluid to the nozzles (7), whereby the nozzles (7) are adapted for discharging fluid under high pressure against the hull surface (3) for cleaning, wherein the housing (2) further comprises a shroud (13) at least partly arranged between the rotary disc (6) and the housing (2), whereby a chamber (14) is provided between the housing (2) and the shroud (13), the chamber (14) being in fluid communication with the suction device (10). The present invention also relates to a vessel or workboat comprising such submergible cleaning system and to use of such submergible cleaning system.

18 Claims, 8 Drawing Sheets

(51) Int. Cl.
*B63B 59/08* (2006.01)
*B63G 8/14* (2006.01)

(56) References Cited

U.S. PATENT DOCUMENTS 5,947,051 A * 9/1999 Geiger ..... B62D 57/00 114/222
7,905,192 B1 * 3/2011 Hertel, III ..... B63B 59/10 114/222
8,393,421 B2 * 3/2013 Kornstein ..... B63B 59/08 180/9.1
8,506,719 B2 * 8/2013 Holappa ..... B08B 1/008 114/222
8,855,268 B1 * 10/2014 Safai ..... G01N 23/203 378/130
2006/0151631 A1 * 7/2006 Redding ..... B05B 1/341 239/383

FOREIGN PATENT DOCUMENTS

GB 2 194 136 3/1988
WO WO 2005/044657 5/2005
WO WO 2009/142506 11/2009
WO WO 2012/074408 6/2012

OTHER PUBLICATIONS

International Search Report for PCT/EP2013/076168 mailed Feb. 20, 2014, 5 pages.
Written Opinion of the ISA for PCT/EP2013/076168 mailed Feb. 20, 2014, 5 pages.

* cited by examiner

SUBMERGIBLE CLEANING SYSTEM

This application is the U.S. national phase of International Application No. PCT/EP2013/076168 filed 11 Dec. 2013, which designated the U.S. and claims priority to EP Patent Application No. 12196544.6 filed 11 Dec. 2012, the entire contents of each of which are hereby incorporated by reference.

FIELD OF THE INVENTION

The present invention relates to a submergible cleaning system for cleaning an underwater hull surface of a vessel while the vessel is afloat or an offshore facility. The present invention also relates to a vessel or workboat comprising such submergible cleaning system and to use of such submergible cleaning system.

BACKGROUND ART

Smooth underwater hull surfaces are essential for ensuring optimum performance of ships, and even a thin layer of slime, which develops rapidly, creates additional friction. Considering the high cost of fuel and the high utilisations of ships, even a marginal additional friction has a significant negative impact on the total fuel cost.

The current anti-fouling paint systems cannot prevent the formation of slime and other fouling within the usual docking intervals; thus, there is a need for underwater hull cleaning between dockings to minimise the formation of slime, fouling and other friction-enhancing objects on the underwater hull.

It is known in the prior art to clean the underwater hull. However, several disadvantages have been observed with these known techniques, namely:

a) The anti-fouling layer, i.e. paint, on the underwater hull may be sporadically damaged, or even in some circumstances completely removed, whereby the underwater hull is exposed to the maritime environment, and thereby there is a huge risk for an increasing future growth rate of the slime on the underwater hull. This is most often the case when mechanical cleaning, that is the application of brushes and similar means, is used.

b) The cleaning of the underwater hull often contaminates the environment with the residues of the anti-fouling layer in the slime. The slime itself can furthermore be harmful to the environment as it may contain non-indigenous species.

c) The cleaning operation is time-consuming, and may in many circumstances exceed the ships' usual turn-around time in the harbours, which may have severe consequences for the ship-owners due to the fact that they cannot then keep to their schedules.

d) The cleaning operations are often performed manually by divers, and the underwater environment provides unfavourable working conditions for the divers. Since the working conditions for the divers are unfavourable, the divers often have an urge to finish the cleaning operations rapidly, which in some circumstances may result in the quality of the cleaning being non-satisfactory.

From WO 2012/074408 A2 a submergible cleaning system is known.

SUMMARY OF THE INVENTION

An object of the present invention is to wholly or partly overcome the above disadvantages and drawbacks of the prior art. More specifically, it is an object to provide a submergible cleaning system, which is systematic, environmentally friendly, quick and cost-efficient.

Furthermore, it is an object of the present invention to provide a submergible cleaning system, wherein the down force is minimised.

It is also an object of the present invention to provide a submergible cleaning system, which can clean the underwater hull and thereby remove slime and other fouling in a gentle manner, substantially without damaging the anti-fouling paint on the hull.

Another object of the present invention is to provide a submergible cleaning system, which minimises the contamination of the environment.

A further object of the present invention is to provide a submergible cleaning system, which may be monitored and controlled in relation to the surface of the underwater hull.

An additional object is to provide a submergible cleaning system with low energy consumption as well as high cleaning efficiency.

Moreover, it is an object to provide a submergible cleaning system which is easy to use with a minimum operative crew by combining manually-controlled and autonomous operational modes.

The above objects, together with numerous other objects, advantages, and features, which will become evident from the below description, are accomplished by a solution in accordance with the present invention by a submergible cleaning system for cleaning an underwater hull surface of a vessel while the vessel is afloat or an offshore facility, the cleaning system comprising:

- a housing comprising a top face and side faces having edges and an open bottom face, the edges and bottom face being arranged opposite the hull surface, and the housing further comprising:
  - a rotary disc having a plurality of nozzles arranged around a periphery of the rotary disc, the nozzles facing the hull surface,
  - rolling spacing devices for providing a predetermined first gap between the rotary disc and the hull surface,
- a suction device fluidly connected to an outlet arranged in the housing for providing a negative pressure within the housing,
- a pressurising device fluidly connected with the nozzles for providing a high pressure fluid to the nozzles, whereby the nozzles are adapted for discharging fluid under high pressure against the hull surface for cleaning, wherein the housing further comprises a shroud at least partly arranged between the rotary disc and the housing whereby a chamber is provided between the housing and the shroud, the chamber being in fluid communication with the suction device.

In an embodiment, the shroud may comprise a top shroud face and side shroud faces having shroud edges and an open bottom shroud face, the shroud edges and bottom shroud face being arranged opposite the hull surface.

Also, the shroud may be arranged within the housing with a predetermined second gap between the side shroud faces and the side faces of the housing.

Said predetermined second gap may be smaller than 0.03 m, preferably smaller than 0.025 m, more preferably smaller than 0.015 m.

The edges of the side face of the housing may be arranged at a first distance from the hull surface.

Moreover, the first distance may be smaller than a second distance between the shroud edges and the hull surface.

Further, the negative pressure in the housing may be controlled during the operation by adjusting the first distance between the edges of the housing and the hull surface.

Also, the negative pressure may create suction within the housing along the edges of the housing.

Suction within the housing may be provided along the edges of the housing.

Also, suction within the housing may be distributed over a large area.

Furthermore, the edges of the housing may comprise a skirt, the skirt being made of a flexible material, so that the housing can be moved on curved and/or double-curved hull surfaces.

Said skirt may be water-permeable.

In an embodiment, a plurality of rotary discs may be arranged within the housing.

Additionally, the shroud may be arranged between the plurality of discs and the housing.

Further, a shroud may be arranged around each rotary disc.

Moreover, two adjacent rotary discs may have opposite directions of rotation for decreasing a friction between them.

Also, the shroud may be arranged between the plurality of discs and the housing.

In addition, a shroud may be arranged around each rotary disc, and a chamber may be arranged around the shroud, the chamber being in fluid communication with the suction device.

The rotary disc(s) may be driven by one or more motor(s).

Also, each rotary disc may comprise a rotational axis, and the nozzles may be supplied with the high pressure fluid through a hollow spindle arranged concentrically to the rotational axis.

Moreover, the suction device may be a pump.

Furthermore, the pressurising device may be a pump.

In an embodiment, the pressure of the fluid leaving the nozzles may be between 30 and 150 bar, preferably between 50 and 125 bar.

In addition, the rolling spacing devices may be adjustable for adjusting the first gap between the rotary disc and the hull surface.

The size of the first gap may be adjusted automatically during the cleaning by adjusting the rolling spacing devices by means of a pressure controller.

Said rolling spacing devices may be wheels.

Further, the rotation of the rotary disc may be adjustable.

In an embodiment, the rotation of the rotary disc may be in the range of 250 to 550 rpm, preferably in the range of 350 to 450 rpm.

Furthermore, the pressure provided to the nozzles may be adjusted in relation to the rotation speed of the rotary discs so that when the rotation speed of the discs decreases, the pressure provided to the nozzles is decreased accordingly and vice versa.

Also, the nozzles may be cavitation type nozzles adapted to induce cavitation in front of the nozzle to provide high and localised stresses on the hull surface due to bubble cavity collapse. Hereby an enhanced erosive power for the cleaning of the hull surface is obtained, and at the same time the pumping power requirement is reduced.

Moreover, the rotary disc may comprise a disc surface arranged opposite the hull surface, the nozzles being arranged below the disc surface.

The nozzles may be arranged in level with the disc surface.

The nozzles may be adapted to be adjusted so that an angle of attack of the high pressure fluid can be altered in view of a rotation direction of the rotary disc.

Further, the nozzles may be interlocked with a pressure switch in the housing, so that the cleaning is provided only when the housing has a negative pressure.

In an embodiment, a residue and debris recovery arrangement may be arranged in relation to the outlet in the housing for collecting effluent water from the cleaning of the hull surface.

Said recovery arrangement may comprise a filter unit adapted to filter the effluent water for residues and/or debris.

The filter unit may be completely submerged so that the suction pump does not have to lift the effluent water above the sea level.

The filtered effluent water may be discharged into the seawater when filtered.

Moreover, the filter unit may comprise a long filter sock.

The submergible cleaning system as described above may further comprise a remotely operated vehicle (ROV).

In addition, the ROV may comprise propulsion means.

Further, the rotation speed of the rotary discs may be adjusted in relation to a speed of the ROV so that when the speed of the ROV increases, the rotation speed of the discs will increase accordingly and vice versa.

In an embodiment, a control unit may be arranged for controlling a 4- to 6-dimensional movement of the ROV while it is submerged.

Thrusters, cameras, sonar equipment, compasses and/or light devices may be arranged in connection with the ROV.

Such thrusters may be electrically powered.

Moreover, the ROV may be equipped with a navigation and orientation device, said navigation and orientation device being connected to the control unit.

Also, a power and utility supply to the cleaning system may be provided from an external source or from the vessel.

The present invention also relates to a vessel or workboat comprising the submergible cleaning system as described above.

In an embodiment, the vessel or workboat may comprise hoisting means arranged to hoist the ROV onto a deck of the vessel and lower the ROV into the water from the vessel.

Further, the control unit may be arranged on the vessel, enabling an operator to control the submergible cleaning system and the ROV.

Additionally, a storage unit may be arranged on the vessel for storing data regarding the cleaning of the underwater hull surface.

Finally, the present invention relates to use of the submergible cleaning system as described above for cleaning an underwater hull surface of a vessel while the vessel is afloat or an offshore facility such as for instance an offshore installation, an oil rig or an offshore wind turbine.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
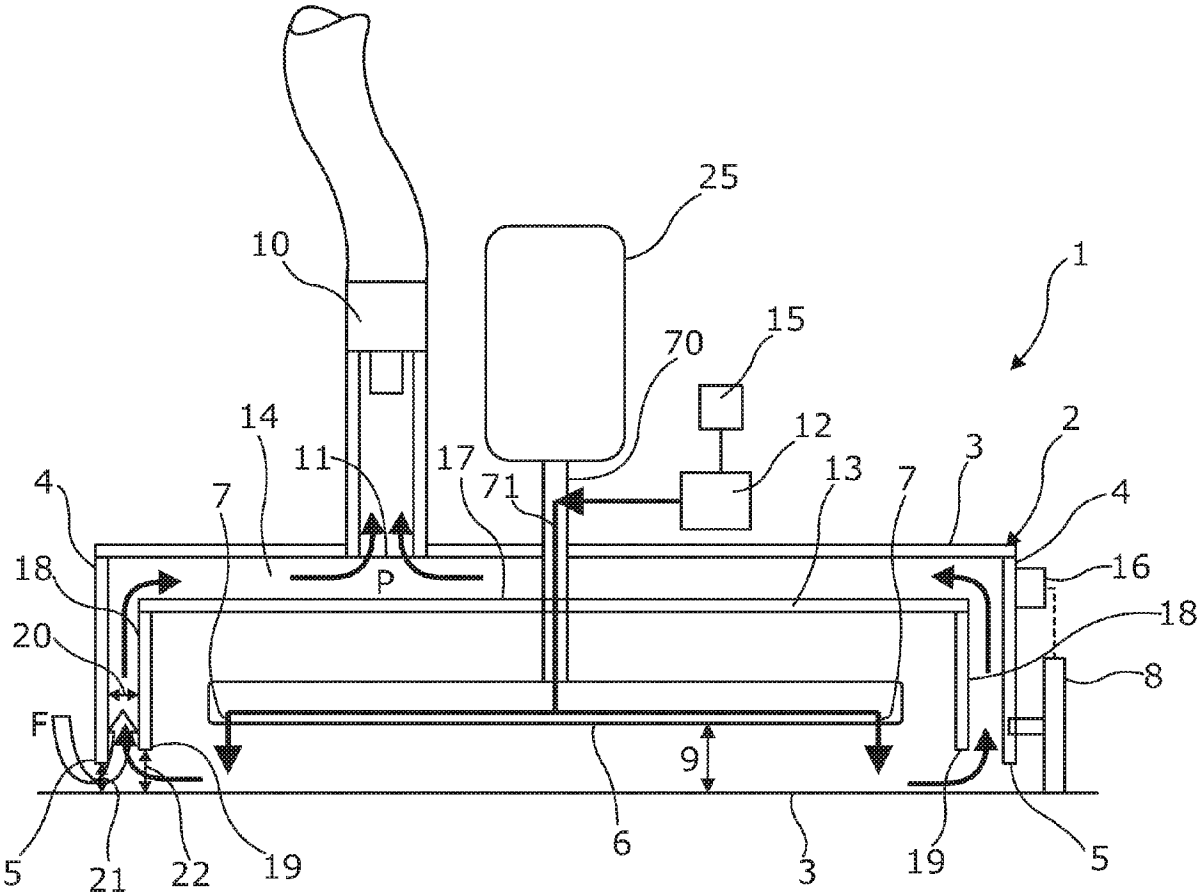
FIG. 1 shows the submergible cleaning system in a schematic side view.

In FIG. 1, a part of the submergible cleaning system 1 for cleaning an underwater hull surface 3 of a vessel while the vessel is afloat, is shown. The cleaning system 1 comprises a housing 2 comprising a top face 3 and side faces 4 having edges 5 and an open bottom face, the edges and bottom face being arranged opposite the hull surface 3 in the cleaning position. The housing 2 further comprises a rotary disc 6 having a plurality of nozzles 7 arranged around a periphery of the rotary disc 6, the nozzles 7 facing the hull surface 3. The housing 2 also comprises rolling spacing devices 8 for providing a predetermined first gap 9 between the rotary disc 6 and the hull surface 3. A suction device 10, for instance a pump, is fluidly connected to an outlet 11 arranged in the housing 2 for providing a negative pressure P within the housing 2.

Furthermore, the cleaning system 1 comprises a pressurising device 12 fluidly connected with the nozzles 7 for providing a high pressure fluid to the nozzles 7, whereby the nozzles 7 are adapted for discharging fluid under high pressure against the hull surface 3 for cleaning.

The housing 2 further comprises a shroud 13 at least partly arranged between the rotary disc 6 and the housing 2. The shroud 13 is arranged at a distance to the housing so that a chamber 14 is provided between the shroud 13 and the housing, the chamber 14 being in fluid communication with the suction device 10. Hereby it is obtained that the suction is applied in the chamber 14 only, causing the down force on the system to be significantly reduced. Also, by providing the negative pressure in the chamber, it is ensured that a constant inflow of water from outside the housing prevents anything from escaping from the cleaning system to contaminate the environments. Furthermore, since the cleaning system 1 according to the present invention has the shroud 13 arranged inside the housing, the necessary water intake velocity is reduced. A further advantage is that the chamber 14 provides a passage through which the debris resulting from the cleaning operation may be sucked by the suction device.

The rotary disc 6 comprises nozzles 7. The nozzles 7 are adapted to impinge a high pressure water spray through the open face onto the hull surface 3 and thereby clean and/or remove the slime, fouling and/or alga from the hull surface 3.

The rotary disc 6 comprises a rotational axis 70, and the nozzles 7 are supplied with the high pressure fluid through a hollow spindle 71 arranged concentrically to the rotational axis 70.

Furthermore, the nozzles 7 may be interlocked with a pressure switch 15, so that the cleaning of the hull surface cannot take place unless the housing 2 has the negative pressure P.

The negative pressure P in the housing 2, and thus the velocity of the inlet water flow F, may be controlled by adjusting the size of the gap between the housing 2 and the hull surface 3. The size of the gap may, in one embodiment, be adjusted automatically during the cleaning by adjustable wheels 8 by means of a pressure controller 16.

Furthermore, the housing 2 may be provided with a skirt or curtain (not shown) made of a flexible material which allows the cleaning system 1 to operate on curved as well as doubled-curved surfaces of the hull surface 3 without jeopardising the recovering of debris. Furthermore, the skirt may be water-permeable.

Furthermore, the shroud 13 may comprises a top shroud face 17 and side shroud faces 18 having shroud edges 19 and an open bottom shroud face, the shroud edges 19 and bottom shroud face being arranged opposite the hull surface 3. As mentioned above, the shroud 13 is arranged within the housing 2 with a predetermined second gap 20 between the side shroud faces 18 and the side faces 4 of the housing 2. The predetermined second gap 20 may be smaller than 0.03 m, preferably smaller than 0.025 m, and more preferably smaller than 0.015 m.

Furthermore, the edges 5 of the side faces 4 of the housing 2 are arranged at a first distance 21 from the hull surface 3. The first distance 21 is smaller than a second distance 22 between the shroud edges 18 and the hull surface 3.

Figure 2:
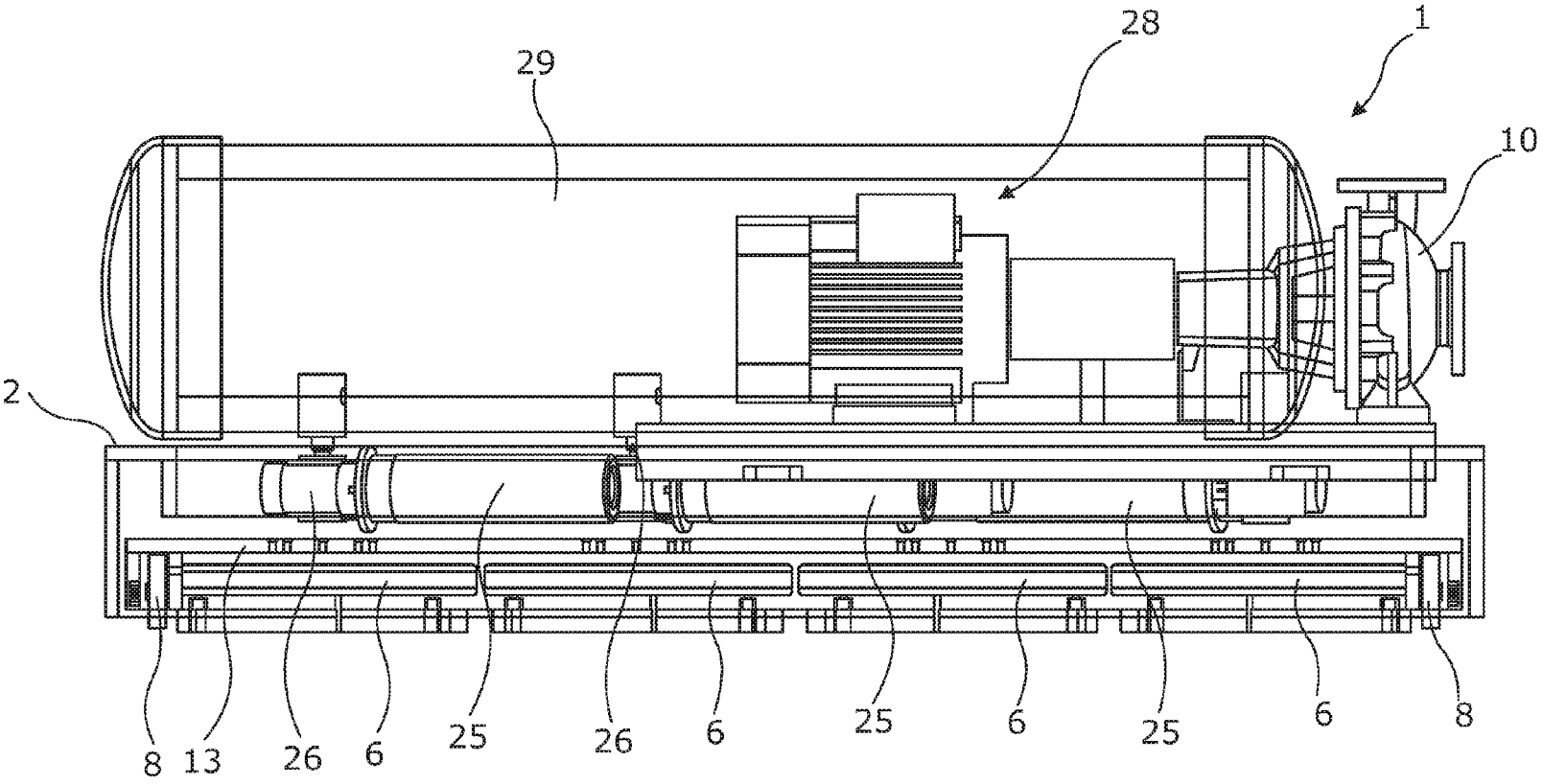
FIG. 2 shows another embodiment of the submergible cleaning system in a partial side view.

FIG. 2 shows another embodiment of the cleaning system 1. In this embodiment, the cleaning system 1 comprises four rotary discs 6 arranged in succession of each other within the shroud 13. As a result, the cleaning system 1 may clean a larger area of the hull surface. Other (not shown) embodiments may comprise a different number of rotary discs. Furthermore, the discs in this embodiment are shown arranged in a row. In other (not shown) embodiments, the rotary discs may be arranged in two or more rows, each row having a plurality of rotary discs.

The shroud 13 is arranged between the rotary discs 6 and the housing 2. The rotary discs 6 are preferably driven by a motor, or in this embodiment by a plurality of motors 25, one for each rotary disc 6. Furthermore, a gearing unit 26 may be arranged with each rotary disc 6.

In an embodiment, two adjacent rotary discs 6 have opposite directions of rotation for decreasing a friction between them, so that the energy consumption may be decreased for the cleaning system 1.

The rotary discs 6 comprise a rotational axis (not shown), and the nozzles are supplied with the high pressure fluid through a hollow spindle (not shown) arranged concentrically to the rotational axis. The pressure of the fluid leaving the nozzles is between 30 and 150 bar, preferably 50 and 125 bar.

Additionally, the rotation speed of the rotary discs may be adjustable. The rotation of the rotary discs may be in the range of 250 to 550 rpm, preferably in the range of 350 to 400 rpm.

Furthermore, the pressure provided to the nozzles may be adjusted in relation to the rotation speed of the rotary discs 6 so that when the rotation speed of the discs 6 decreases, the pressure provided to the nozzles are decreased accordingly and vice versa. Hereby it is obtained that the cleaning of the surface to be cleaned may be performed more smoothly, since the power to the nozzles are adjusted in view of the rotation speed of the rotary discs.

Furthermore, a residue and debris recovery arrangement 28 is arranged in relation to the outlet (not shown) in the housing 2 for collecting effluent water from the cleaning of the hull surface. The recovery arrangement 28 comprises a filter unit 29 adapted to filter the effluent water for residues and/or debris. The filtered effluent water may be discharged into the seawater when filtered. Furthermore, the pump 10 is adapted to provide suction inside the housing 2.

Figure 3:
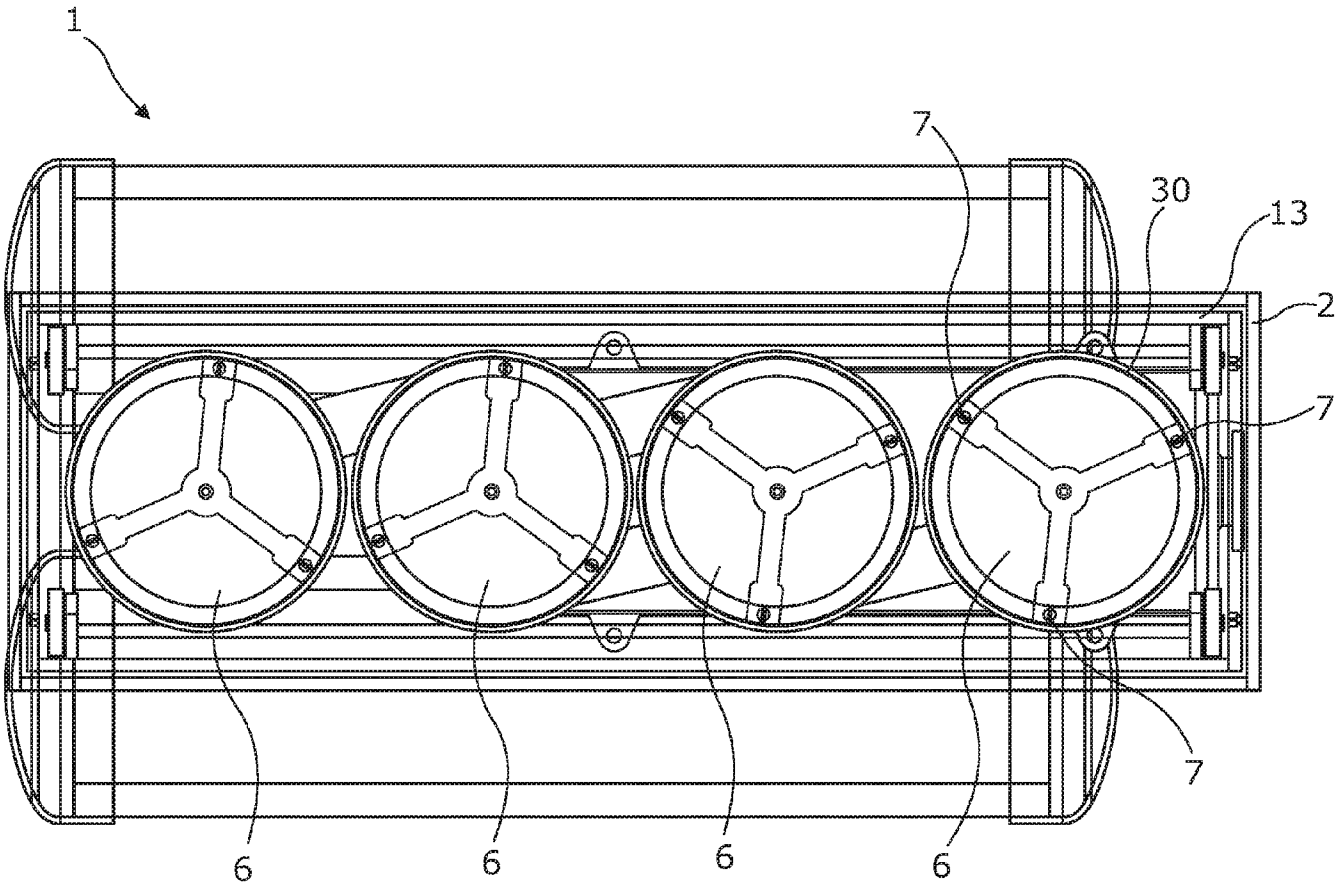
FIG. 3 shows the cleaning system of FIG. 2 in a bottom view.

In FIG. 3, the cleaning system 1 of FIG. 2 is shown in a bottom view. The four rotary discs 6 are shown within the shroud 13. In this embodiment, each disc 6 has 3 nozzles 7 arranged along the periphery 30. Advantageously, the nozzles 7 are cavitation type nozzles adapted to induce cavitation in front of the nozzle to provide high and localised stresses on the hull surface due to bubble cavity collapse. Hereby an enhanced erosive power for the cleaning of the hull surface is obtained, and at the same time the pumping power requirement is reduced. Thus, by using cavitation type nozzles 7, efficient cleaning may be obtained at lower fluid pressure than in the prior art. Also, the rotary disc may comprise a disc surface arranged opposite the hull surface, the nozzles being arranged below the disc surface. Additionally, the nozzles may be adapted to be adjusted so that an angle of attack of the high pressure fluid can be altered in view of a rotation direction of the rotary disc.

Figure 4:
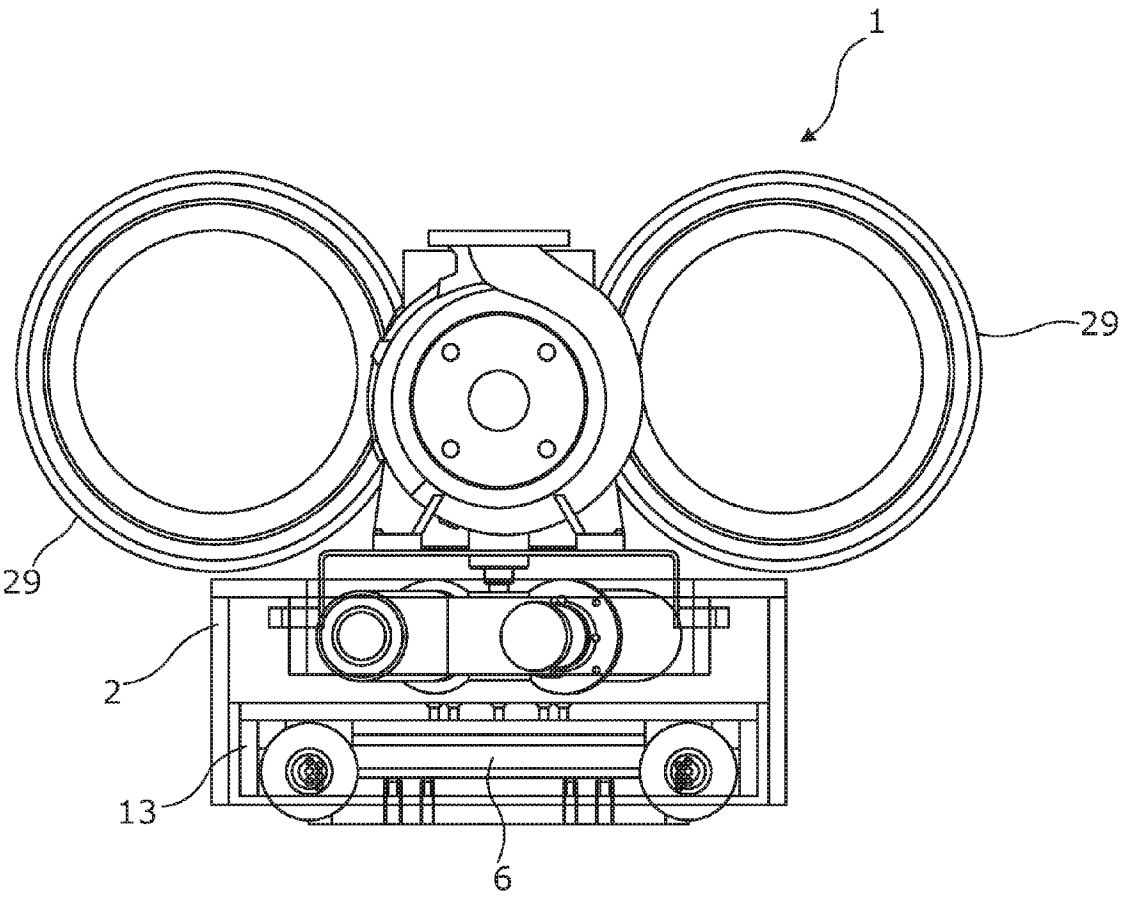
FIG. 4 shows the cleaning system of FIG. 2 in an end view.

In FIG. 4, the cleaning system 1 of FIG. 2 is shown in an end view. The cleaning system 1 has two filter units 29 arranged on top of the housing 2.

On the water's surface, a workboat or vessel (to be described further below) may be used to manage the following: guide wire to the ROV, power supply to the ROV, winch for tether and waste hose, lifting capacity to launch and recover ROV and the external filter. Also a small RIB boat may be used for support during the cleaning operation.

Figure 5:
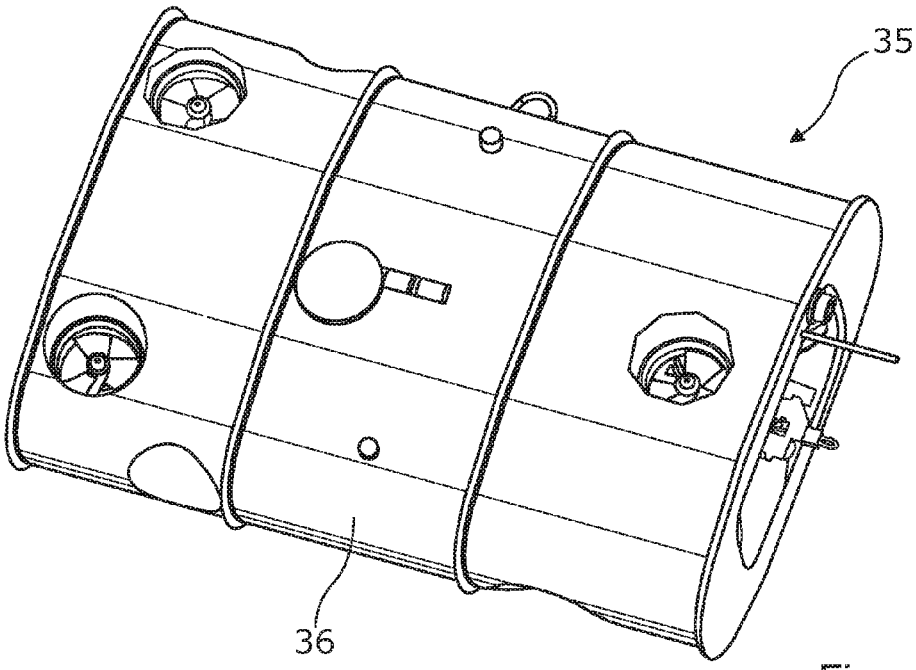
FIG. 5 shows the ROV of the cleaning system with a cover in a top view.

The cleaning system 1 also comprises a remotely operated vehicle (ROV) 35, as shown in FIG. 5. The ROV 35 is shown with a cover 36. The ROV may, in general, be equipped as a work-class ROV but be fully adapted to clean ship hulls in terms of thruster orientation, physical design, payload and sensors so that the ROV may be adapted to 4- to 6-dimensional movement while being submerged, preferably to 6-dimensional movement. The ROV may be powered electrically from surface through a neutrally-buoyant tether also including optical telemetry for communication.

Figure 6:
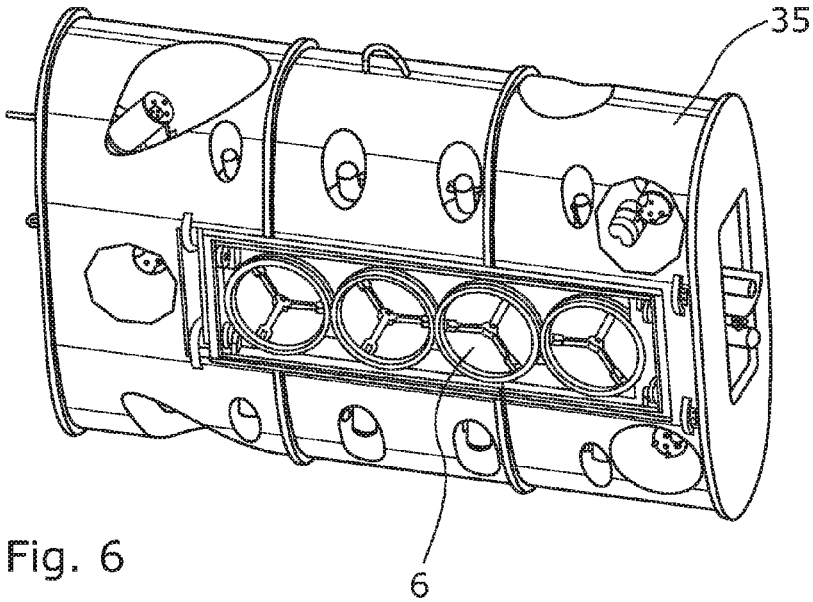
FIG. 6 shows the ROV of FIG. 5 in a bottom view.

In FIG. 6, the ROV 35 is shown in a bottom view disclosing the rotary discs 6. The different elements of the ROV will be described further below.

Figure 7:
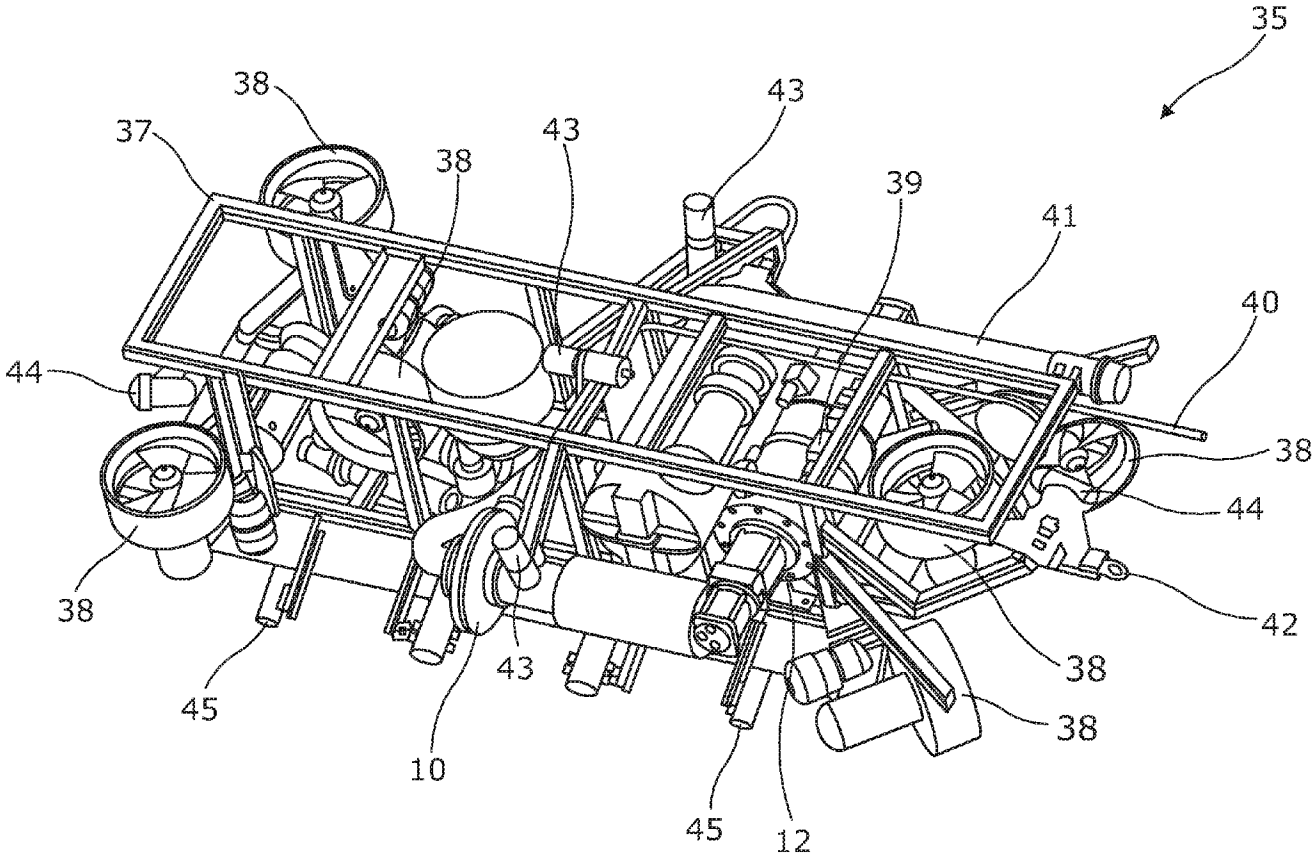
FIG. 7 shows the ROV of FIG. 5 with the cover off.
Figure 8:
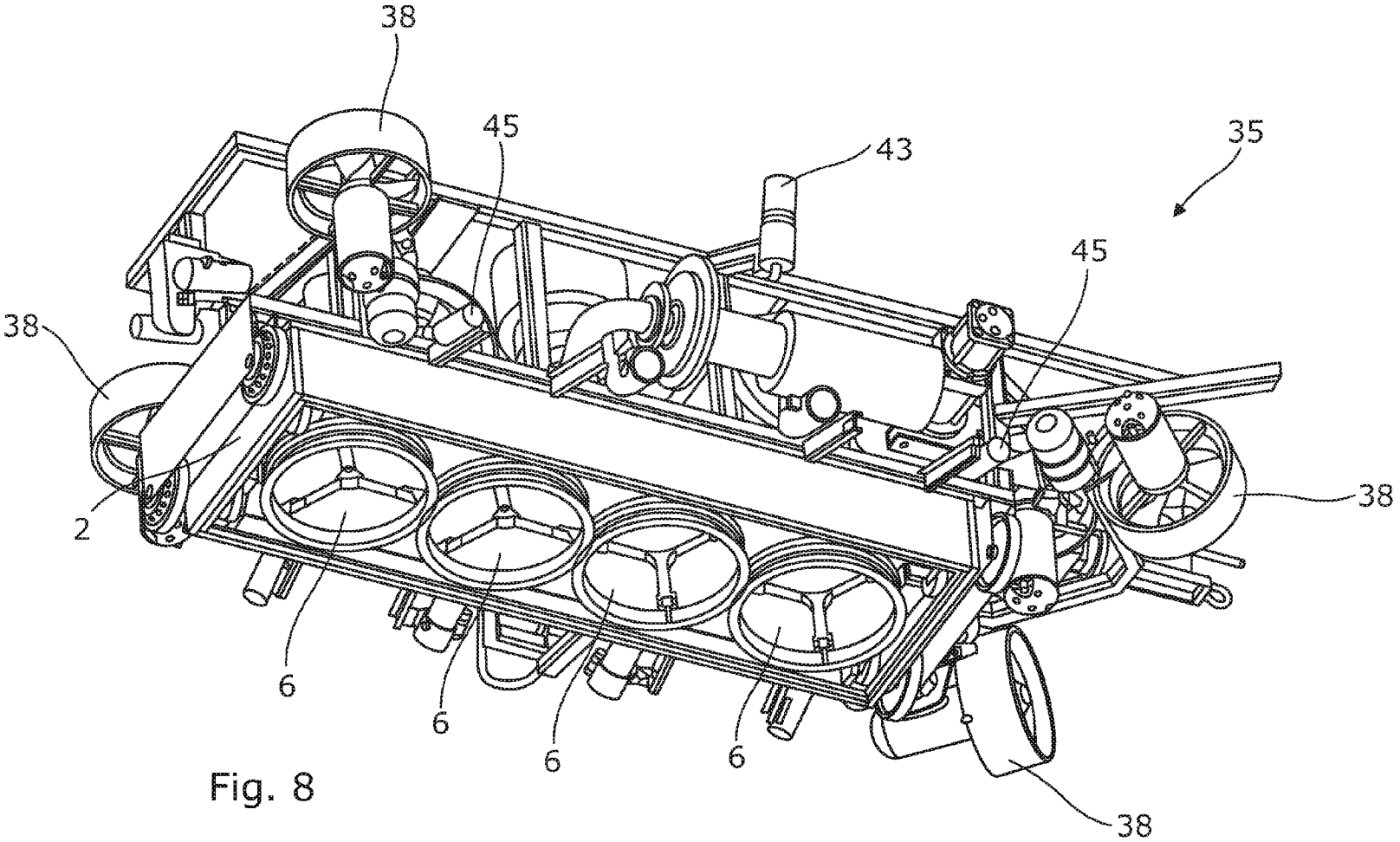
FIG. 8 shows the ROV of FIG. 5 with the cover off in a bottom view.

In FIGS. 7 and 8, the ROV 35 is shown without the cover and comprises a frame 37 which will be built by welded stainless steel profiles. The frame 37 will serve as the foundation for all heavy equipment like pumps, motors and thrusters 38. This frame 37 is also connected to the lifting point making it safe to handle during launch and recovery operations.

The ROV 35 is, in this embodiment, propelled by six thrusters 38 of 4.5 kW each. Three thrusters will press the ROV and thereby the cleaning system 1 against the target hull surface, and the other three thrusters will control the ROV movement forwards/backwards and sideways, and control ROV heading. Depending on the thrusters' relative position, the thruster and buoyancy material configuration together with the ROV control system make the ROV controllable in all six degrees of freedom (i.e. 6-dimensional movement), i.e. forwards/backwards, sideways, up/down, heading, pitch and roll. The reason to use six equal and quite powerful motors is to get a stable ROV that can hold its position and follow its track in turbulent and high current waters. The ROV will also be big in volume and weight so powerful thrusters are required to get a vehicle with good response. It is also advantageous to have only one type of motor seen from a spare parts perspective.

The thrusters are preferably electrically powered for obtaining accurate and vibration-less operation.

The high pressure pump 12 may comprise self-cleaning filter for the inlet water to the high pressure pump. The self-cleaning mechanism is driven by a motor driven by water pressure.

The high pressure is provided by two fixed displacement axial piston pump units 12 that are driven by a double shaft 3000V/60 Hz motor. These pumps 12 together provide a fixed flow of 340 l/min. 20 l/min from these pumps will be used for self-cleaning, and 1 l/min is used for the water motor drive of the filter. Each pump unit is connected to two rotary discs 6. This means that it is possible to run just two rotary discs if desirable.

In order to be able to reduce the flow to the nozzles when required, a proportional control valve 39 may be arranged after two of the high pressure pumps. These valves 39 are also used to turn the flow to the nozzles on and off, together with the relief valve described below.

A relief valve may be arranged after the other two pumps to be able to turn the flow to the nozzles on and off. To reduce the back pressure (pump/motor load) when starting up the pumps, the flow will also be turned off (pressure relief valve dumping to ambient sea).

The suction pump 10 is positioned on the ROV, since the pump must be close to the source. The pump is a particle and environmentally friendly centrifugal pump with approximately 620 L/min capacity at rated pressure drop. The pressure drop has been calculated by considering the diameter and length of the waste hoses plus other factors such as different junctions and external filter. The power needed to operate the suction pump is in the 10 kW range.

The concept for the external filter is a big "filter bag" that floats just below the surface. The filter is connected to a buoy at the surface to make it possible to see where it is and to make it more easily retrievable. A weight is arranged in the bottom of the filter to hold it in position. The debris inlet is also arranged in the bottom part of the filter bag. During cleaning operations, the external filter is positioned alongside the target ship. The filter follows the ROV as it moves along the target ship, since the debris hose is of a fixed length and connected to both the bag and the ROV. The position of the filter can, if necessary, be adjusted using support ropes that can be attached alongside the target ship and controlled from the platform/cleaning support vessel. The small RIB boat is also used to monitor the position and the status of the filter.

When the filter bag is lifted out of the water with a crane, the remaining water will drain, leaving only the debris. The basic concept is to use a disposable filter.

The tether 40 from the workboat 50 consists internally of cables for 3000 VAC, 500 VDC, and optically they will be spliced up in an oil-filled junction box on the ROV end. The first part is the 3000 VAC going to the pumps in two different cables, the second part is the 500 VDC going to the ROV main pressure housing. The third part is the optical fibre going to the ROV main pressure housing. To remove the tether 40 from the ROV, the connectors for 3000 VAC, 500 VDC and optical fibre need to be disconnected. The location of the tether inlet to the ROV is on the same side as the hose connection 41 and the guide wire 42.

The waste hose 41 connection to the external filter needs to be easily handled from the RIB boat 52 when replacing the filter bag.

The guide wire 42 is attached on the ROV on the same side as the waste hose and the tether. The idea is to have it easily accessible from the RIB boat 52 in order to be able to disconnect when cleaning parts close to the ship propeller.

The ROV may be equipped with two sonars 43. One profiling sonar may be used to monitor the environment, the distance to the bottom and the quay etc. The other sonar may be a forward-looking high resolution sonar that is used to avoid obstacles etc.

A preliminary test shows that it may be possible to detect the border between a cleaned and a not-cleaned surface on the target hull, so that the sonars may assist in navigation control.

A light and camera may be mounted on each of the two pan and tilt units 44. The angular observation range of these units 44 will be limited by the surrounding ROV components and the cabling for light and camera. The pan and tilt units 44 will be positioned for maximum viewing angle in all directions, which is particularly useful for identifying obstacles in conjunction with data from the obstacle avoidance sonar.

The pan and tilt unit 44 angular positions are programmable: it is possible to define multiple set-points and by the press of a button resume previously-programmed camera viewing headings. This feature may be used for quickly reconfiguring the ROV during operations, e.g. to ensure that the cameras are pointed in the direction of ROV travel.

Six colour video cameras 45 may be mounted on the ROV. Two of them are movable via pan and tilt units, and four are arranged in a fixed position. The cameras 45 act both as observation and navigation cameras.

The housing 2 with a soft skirt or curtain reducing the first distance to the hull surface combined with the flow of the suction pump will prevent any debris from leaking out during cleaning.

It is possible to control the rotation speed of the rotary discs 6 independently of water flow to the rotary discs. The rotation speed needs to be changed depending on the forward speed of the ROV. The reference point is 400 rpm at a forward speed of 0.5 ms. The control system will provide functionality to ensure that if the ROV slows down, the rotary discs slow down proportionally.

The motors 25 for the rotary discs may be 3 phase delta coupled 400 VAC motors with a maximum of 1.5 kW per motor. The motors will be powered from the main 500 VDC through individual motor drivers.

Figure 9:
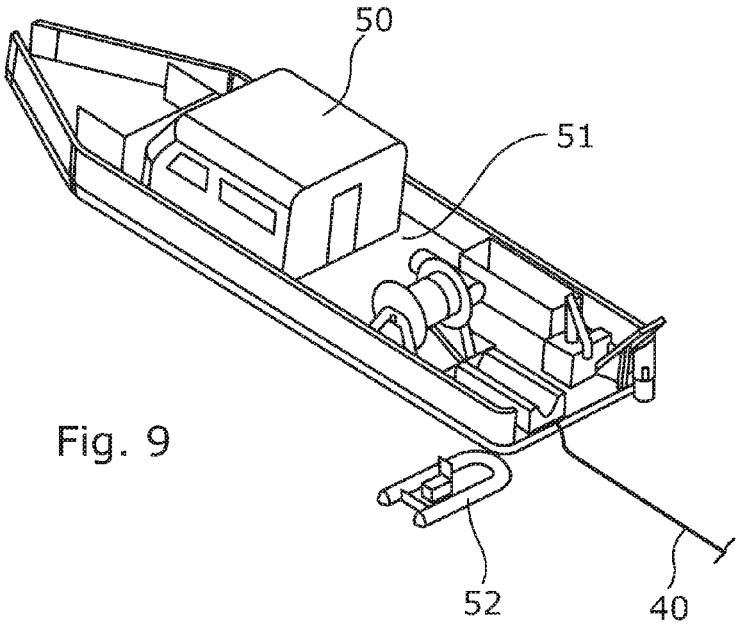
FIG. 9 shows a workboat.

The main surface platform for the cleaning system 1 is a vessel or workboat 50 as seen in FIG. 9, which during operation is placed at and moored to the quay and in front of or behind the target ship. A filter bag for the debris will follow the ROV alongside the target ship. A small RIB boat 52 is also required to assist and handle the filter bag and may be used for other support issues.

The ROV control sensors consist of depth sensor, gyroscope, accelerometers and Doppler Velocity Log (DVL) (optional). They are used to control the ROV in all degrees of freedom.

Other sensors like fixed length data from guide wire winch, wheel data, DVL (optional) will be used together with the ROV control sensors to determine the position of the ROV. An accurate GPS will be installed on the workboat to have a point of origin in case of aborted missions and to be able relocate and continue the mission later on.

A typical cleaning scenario is that the ROV works its way forward in steps of 1.6 m, making an orthogonal trajectory seen from the ship direction. The trajectory is determined by the guide wire length. The ROV control system will always have the guide wire elongated by using two horizontal thrusters. It also commands three vertical thrusters to push the vehicle against the hull of the ship. The wheels and the DVL (optional) will indicate and give warnings on the MMI if the ROV is so far off the hull that the cleaning result is affected Several help functions can be introduced depending on the rotational speed of the drives, and the water pressure is regulated by the vessel's steering system. The water pressure and the rotation speed can for instance automatically change depending on the forward speed of the ROV.

All the trajectories including sensor data from the ROV, like heading, pitch, roll, depth, wire length, wheel data and DVL (optional) are used to determine if the hull has been fully cleaned and are presented in real time to the pilot during the operation.

All position data and camera pictures are logged and could be viewed after the operation on a playback HMI in the software. That playback function can also be installed on a standard computer. This logged data is stored on a separate hard drive for quality control.

The workboat 50 may have a lifting crane 54 to handle the load.

The tether 40 will be positively buoyant, and if needed mark-up buoys could be attached to make it more visible at surface. The tether 40 will be attached to the external filter buoy and strain relieved attached to the waste hose down to the ROV.

In order to be able to navigate the ROV, a guide wire is attached to the ROV. The guide wire may be a 3 mm Dyneema line that goes through a Tether Protection System 57 (TPS) to a one layer winch that controls the length of the line. The tension from the winch 56 is fixed and not adjustable up to a point where it will start to feed out in order to avoid that the line breaks. A sensor on the winch will measure the tension in the guide wire to be able to calculate the position of the TPS weight and maintain the track for the ROV.

The concept for the TPS 57 is dependent on the appearance of the platform for the equipment. The existing TPS consists of the TPS with winch and a TPS Launcher.

Figure 10:
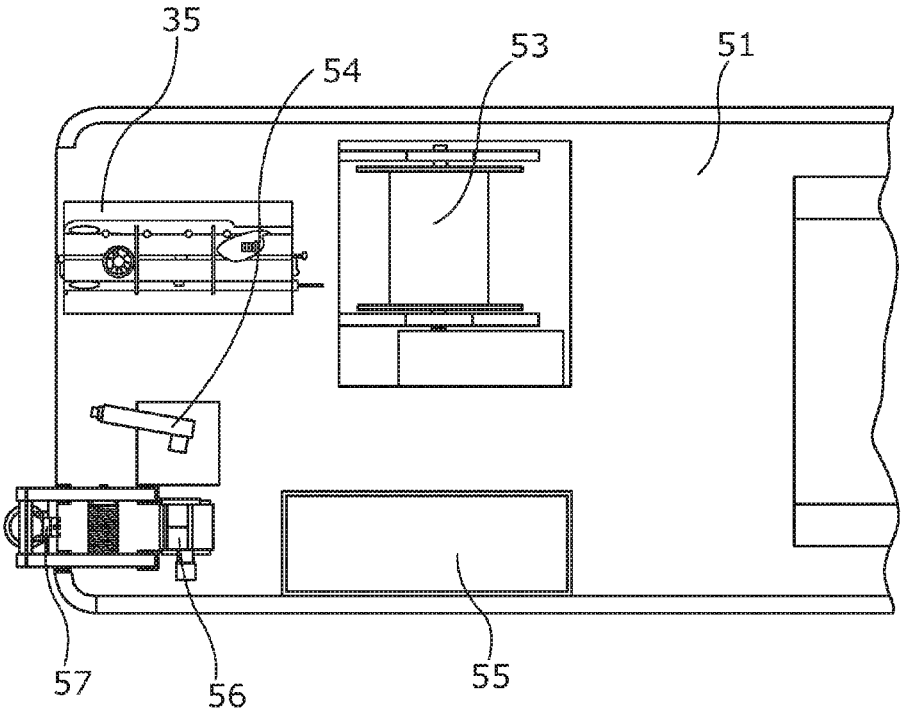
FIG. 10 shows equipment arranged on the deck of the workboat.

The workboat 50 as shown in FIG. 10 must be equipped with a lifting crane 54 with load, lift height and extension capacity to handle all the parts to be launched and recovered like the ROV 35 and filter bag 55.

The boat 50 needs to have available space on the deck 51 for the system winches, TPS with framework, the ROV 35 in a cradle as well as space for handling the filter bag. The operator needs an area which is easily accessible inside the workboat 50 in which to run the system The preferred option is to have a workboat with hover capability to obviate anchoring or lashing to the quay or ship to be cleaned. This would also minimise movements that will negatively affect the cleaning result.

The cleaning of a vessel may comprise the following steps in normal conditions:

- If the environment requires it, attach support ropes for the filter bag alongside the target ship.
- Position the ROV platform in front of the target ship.
- Launch the ROV, lower the TPS, feed out the guide wire, feed out tether and feed out the ROV waste hose.
- After 80 m, start attaching floats to the tether every 20 m Launch the filter bag and attach it, if necessary, to the support ropes. Attach the ROV waste hose to the external filter bag and ensure that the other end is securely attached to the ROV.

Position the ROV and start cleaning the target ship. Adjust the position of the filter bag and feed out tether, when necessary.

When the operator is confronted with various obstacles such as bilge keels etc. along the predefined cleaning track, the ROV will be required to navigate between the surface and the bilge keels until these obstacles no longer hinder hull access along the predefined cleaning track. Cleaning is then resumed from the next available safe hull touchdown location.

When the cleaning pattern has been completed, navigate the ROV to the platform and recover the tether and the vehicle to deck. Recovery will also be required when shifting platform position from the fore position to the aft of the ship. Retrieve the filter bag to deck and store until it is retrieved on-shore for prearranged disposal/destruction.

Remove the support ropes for the filter bag alongside the target ship.

The operation procedure under marginal weather conditions is the same as for normal conditions, the main difference being the time required to perform an operation. If visibility is limited and if there is a strong current, the speed of the vehicle will decrease. In case of strong winds with big waves, it is more difficult—and therefore more time-consuming—to position the platform, moor the platform and handle the filter bag etc.

By using the cleaning system according to the invention, a gentle cleaning of the underwater hull is obtained. At the same time, the cleaning process is—due to the residue and debris recovery arrangement—very environmentally friendly, and it will essentially not contaminate the environment. Additionally, the ROV and the control unit ensure that the cleaning process may be planned according to the actual design of the underwater hull, and during the actual cleaning process, the underwater hull may be monitored so that it is ensured that the entire underwater hull is cleaned as intended.

Although the invention has been described in the above in connection with preferred embodiments of the invention, it will be evident for a person skilled in the art that several modifications are conceivable without departing from the invention as defined by the following claims.

The invention claimed is:

1. A submergible cleaning system for cleaning an underwater hull surface of a vessel while the vessel is afloat or an offshore facility, the cleaning system comprising:

a housing comprising a top face and side faces having edges and an open bottom face, the edges and bottom face being structured to be arranged opposite a hull surface, and the housing further comprising:

a rotary disc having a plurality of nozzles arranged around a periphery of the rotary disc, the nozzles being positioned to face the hull surface, rolling spacing devices for providing a predetermined first gap between the rotary disc and the hull surface, a suction device fluidly connected to an outlet arranged in the housing for providing a negative pressure within the housing, a pressurising device fluidly connected with the nozzles for providing a pressurized fluid to the nozzles, whereby the nozzles are adapted for discharging fluid under pressure against the hull surface for cleaning, wherein the housing further comprises a shroud at least partly arranged between the rotary disc and the housing, whereby a chamber is provided between the housing and the shroud, the chamber being in fluid communication with the suction device.

2. A submergible cleaning system according to claim 1, wherein the shroud comprises a top shroud face and side shroud faces having shroud edges and an open bottom shroud face, the shroud edges and bottom shroud face being arranged opposite the hull surface.

3. A submergible cleaning system according to claim 2, wherein the shroud is arranged within the housing with a predetermined second gap between the side shroud faces and the side faces of the housing.

4. A submergible cleaning system according to claim 1, wherein the edges of the side face of the housing are arranged at a first distance from the hull surface.

5. A submergible cleaning system according to claim 4, wherein the first distance is smaller than a second distance between the shroud edges and the hull surface.

6. A submergible cleaning system according to claim 4, wherein the negative pressure in the housing is controlled during the operation by adjusting the first distance between the edges of the housing and the hull surface.

7. A submergible cleaning system according to claim 1, wherein the negative pressure creates suction within the housing along the edges of the housing.

8. A submergible cleaning system according to claim 1, wherein a plurality of rotary discs are arranged within the housing.

9. A submergible cleaning system according to claim 1, wherein each rotary disc comprises a rotational axis, and the nozzles are supplied with the pressurized fluid through a hollow spindle arranged concentrically to the rotational axis.

10. A submergible cleaning system according to claim 1, wherein the rolling spacing devices are adjustable for adjusting the first gap between the rotary disc and the hull surface.

11. A submergible cleaning system according to claim 10, wherein the size of the first gap is adjusted automatically during cleaning by adjusting the rolling spacing devices with a pressure controller.

12. A submergible cleaning system according to claim 1, wherein the nozzles are cavitation type nozzles adapted to induce cavitation in front of each nozzle to provide high and localised stresses on the hull surface due to bubble cavity collapse.

13. A submergible cleaning system according to claim 1, wherein the nozzles are interlocked with a pressure switch in the housing, so that cleaning is provided only when the housing has a negative pressure.

14. A submergible cleaning system according to claim 1, wherein a recovery arrangement is arranged in relation to the outlet in the housing for collecting effluent water from cleaning of the hull surface.

15. A submergible cleaning system according to claim 14, wherein the recovery arrangement comprises a filter unit adapted to filter the effluent water for residues and/or debris.

16. A submergible cleaning system according to claim 1, further comprising a remotely operated vehicle (ROV).

17. A submergible cleaning system according to claim 16, wherein a rotation speed of rotary discs are adjusted in relation to a speed of the ROV so that when the speed of the ROV increases, the rotation speed of the discs will increase accordingly and vice versa.

18. A submergible cleaning system according to claim 16, wherein a control unit is arranged for controlling a 4- to 6-dimensional movement of the ROV while the ROV is submerged.

* * * * *